US007941530B2

(12) United States Patent
Ha et al.

(10) Patent No.: US 7,941,530 B2
(45) Date of Patent: May 10, 2011

(54) THERMOSTAT STATUS NOTIFICATION THROUGH A NETWORK

(75) Inventors: Wai-leung Ha, Pokfulam (HK); Kairy Kai Lei, Shen Zhen (CN); Gordon Qian, Shen Zhen (CN); Hao-hui Huang, Shen Zhen (CN)

(73) Assignee: Computime, Ltd, Wanchai (HK)

( * ) Notice: Subject to any disclaimer, the term of this patent is extended or adjusted under 35 U.S.C. 154(b) by 206 days.

(21) Appl. No.: 12/253,561

(22) Filed: Oct. 17, 2008

(65) Prior Publication Data

US 2010/0100358 A1 Apr. 22, 2010

(51) Int. Cl.
*G06F 15/173* (2006.01)

(52) U.S. Cl. ..... 709/224; 709/203; 709/217; 709/220; 700/80; 62/132

(58) Field of Classification Search ..... 709/203, 709/217, 220, 224; 62/132
See application file for complete search history.

(56) References Cited

U.S. PATENT DOCUMENTS

| | | | | |
|---|---|---|---|---|
| 5,086,385 | A * | 2/1992 | Launey et al. | 700/83 |
| 5,838,226 | A * | 11/1998 | Houggy et al. | 340/310.11 |
| 6,029,092 | A * | 2/2000 | Stein | 700/11 |
| 6,192,282 | B1 * | 2/2001 | Smith et al. | 700/19 |
| 6,778,945 | B2 * | 8/2004 | Chassin et al. | 702/188 |
| 6,999,996 | B2 * | 2/2006 | Sunderland | 709/208 |
| 7,000,422 | B2 * | 2/2006 | Street et al. | 62/298 |
| 7,222,800 | B2 | 5/2007 | Wruck | |
| 7,228,691 | B2 * | 6/2007 | Street et al. | 62/132 |
| 2003/0204595 | A1 * | 10/2003 | Lev et al. | 709/226 |
| 2004/0059815 | A1 * | 3/2004 | Buckingham et al. | 709/224 |
| 2005/0040248 | A1 | 2/2005 | Wacker et al. | |
| 2005/0150967 | A1 | 7/2005 | Chapman, Jr. et al. | |
| 2006/0055549 | A1 | 3/2006 | Fischer et al. | |
| 2006/0168170 | A1 * | 7/2006 | Korzeniowski | 709/223 |
| 2007/0061046 | A1 * | 3/2007 | Mairs et al. | 700/275 |
| 2008/0048046 | A1 * | 2/2008 | Wagner et al. | 236/91 R |
| 2008/0099568 | A1 | 5/2008 | Nicodem et al. | |
| 2008/0218148 | A1 * | 9/2008 | Robertson et al. | 323/349 |
| 2009/0088902 | A1 * | 4/2009 | Williams | 700/278 |
| 2009/0206059 | A1 * | 8/2009 | Kiko | 218/143 |

FOREIGN PATENT DOCUMENTS

CN 1699864 A 11/2005

OTHER PUBLICATIONS

International Search Report for PCT/CN2009/074478, dated Jan. 14, 2010, pp. 1-3.
ZigBee Smart Energy Profile Specification, May 29, 2008, pp. 1-202, ZigBee Standards Organization.
ZigBee Library Specification, May 29, 2008, pp. 1-420, ZigBee Standards Organization.

* cited by examiner

*Primary Examiner* — Michael Won
(74) *Attorney, Agent, or Firm* — Banner & Witcoff, Ltd.

(57) ABSTRACT

The present invention provides apparatuses and computer readable media for obtaining status information from a heating, ventilating, and air conditioning (HVAC) system and sending the status information to a remote networked device using a data container. A thermostat obtains status information from a HVAC system, associates the status information with a corresponding index number, and includes the index number and HVAC information in a data container. The data container can assume different forms, including a customer-defined cluster or a publicly accessible cluster. The HVAC information may be encoded so that the HVAC information can be included as an attribute of the publicly accessible cluster. HVAC information may include relay status of a relay in the HVAC system. The relay is identified by an index number that is included in an attribute. A networked device typically receives the HVAC information from the thermostat in at least one data container.

14 Claims, 9 Drawing Sheets

400

401 402 403 404 405 406 407 408

| | Basic Info | Relay 1 | Relay 2 | Relay 3 | Relay 4 | Relay 5 | Relay 6 | Relay 7 |
|---|---|---|---|---|---|---|---|---|
| Report Index value | 0 | 1 | 2 | 3 | 4 | 5 | 6 | 7 |
| | | | | | | | | |
| | No of bits | | | | | | | |
| Report Index | 4 | 4 | 4 | 4 | 4 | 4 | 4 | 4 |
| HVAC Type | 8 | | | | | | | |
| Total PCT Op Time (min) | 32 | | | | | | | |
| Reserved | 16 | | | | | | | |
| | | | | | | | | |
| Relay on time (min) | | 24 | 24 | 24 | 24 | 24 | 24 | 24 |
| Relay no of cycles | | 20 | 20 | 20 | 20 | 20 | 20 | 20 |
| Relay last hour on time (min) | | 8 | 8 | 8 | 8 | 8 | 8 | 8 |
| Relay last hour no of cycle | | 4 | 4 | 4 | 4 | 4 | 4 | 4 |
| | | | | | | | | |
| | | | | | | | | |
| | 60 | 60 | 60 | 60 | 60 | 60 | 60 | 60 |

FIG. 4

THERMOSTAT STATUS NOTIFICATION THROUGH A NETWORK

BACKGROUND

The smart energy market often utilizes a wireless network to provide metering and energy management. Wireless networking include neighborhood area networks for meters, using wireless networking for sub-metering within a building, home or apartment and using wireless networking to communicate to devices within the home. Different installations and utility preferences often result in different network topologies and operation. However, each network typically operates using the same basic principals to ensure interoperability. Also, smart energy devices within a home may be capable of receiving public pricing information and messages from the metering network. However, these devices may not have or need all the capabilities required to join a smart energy network.

A smart energy network may assume different network types, including a utility private home area network (HAN), a utility private neighborhood area network (NAN), or a customer private HAN. A utility private HAN may include an in-home display or a load control device working in conjunction with an energy service portal (ESP), but typically does not include customer-controlled devices.

A smart energy network may interface with different types of devices including a heating, ventilating, and air conditioning (HVAC) system. With the increasing cost of energy, it is important that a HVAC system operates efficiently and reliably. Consequently there is a real market need to provide information of different components in a HVAC system through a wireless network.

SUMMARY

The present invention provides apparatuses and computer readable media for obtaining status information from a heating, ventilating, and air conditioning (HVAC) system and sending the status information to a remote networked device using a data container.

With another aspect of the invention, a thermostat obtains status information from a HVAC system, associates the status information with a corresponding index number, and includes the index number and HVAC information in a data container. The data container can assume different forms, including a customer-defined cluster or a publicly accessible cluster.

With another aspect of the invention, the HVAC information is encoded so that the HVAC information can be included as an attribute of a publicly accessible cluster.

With another aspect of the invention, HVAC information includes relay status of a relay in the HVAC system. The relay status may further include relay on time information and relay number of cycles information for the relay. The relay is identified by an index number that is included in an attribute.

With another aspect of the invention, a networked device receives HVAC information from a thermostat. The networked device receives at least one data container having a plurality of status information from a heating, ventilating, and air conditioning (HVAC) system in a data container. Each status information is associated with a different index number. The networked device can read a selected status information using a selected index number.

BRIEF DESCRIPTION OF THE DRAWINGS

The foregoing summary of the invention, as well as the following detailed description of exemplary embodiments of the invention, is better understood when read in conjunction with the accompanying drawings, which are included by way of example, and not by way of limitation with regard to the claimed invention.

FIG. 4 shows exemplary thermostat internal information in accordance with an embodiment of the invention.

DETAILED DESCRIPTION

Embodiments of the invention reference the following terms.

Attribute: A data entity which represents a physical quantity or state. This data is communicated to other devices using commands.

Cluster: A container for one or more attributes and/or messages in a command structure.

Figure 1:
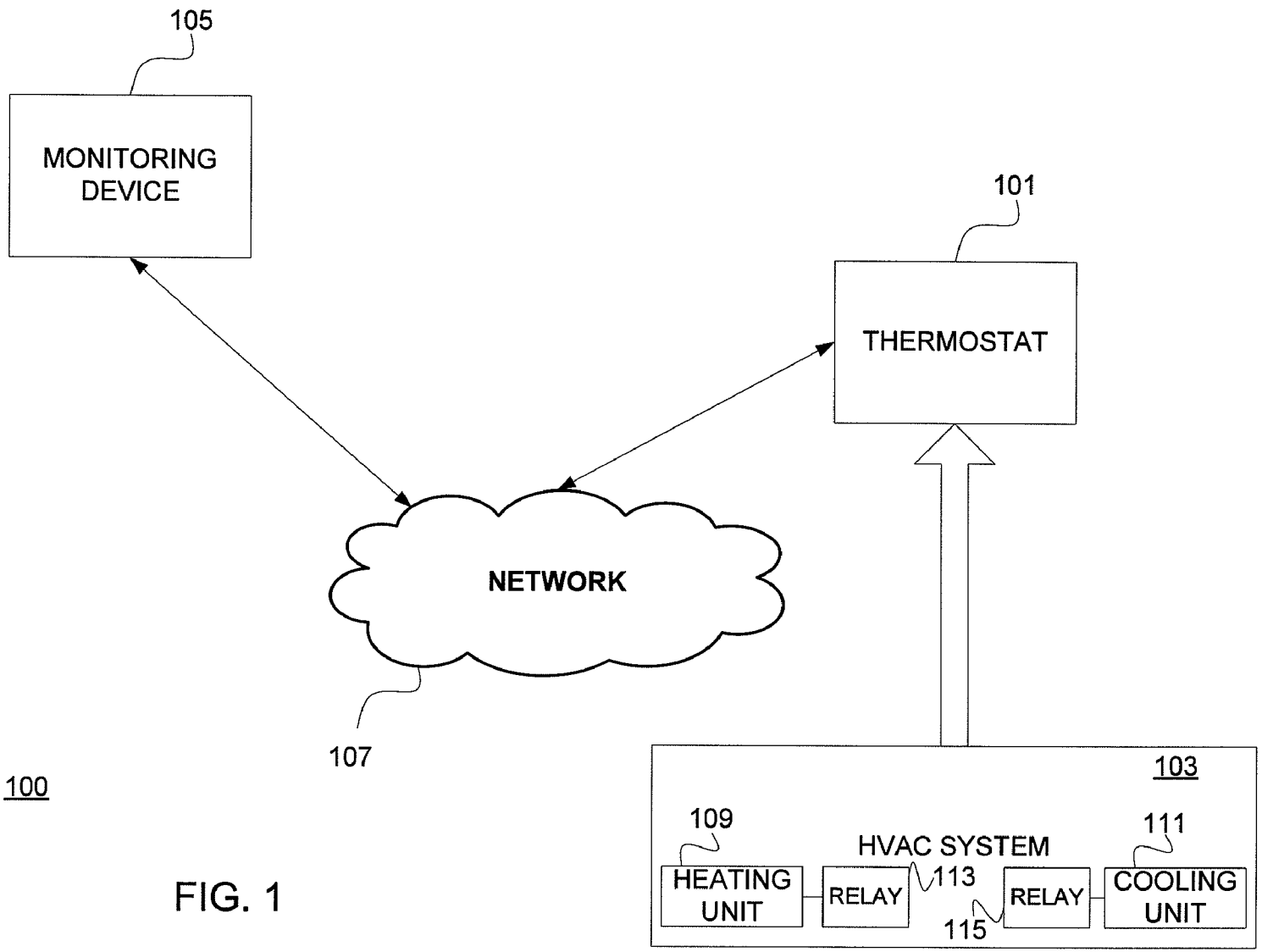
FIG. 1 shows a networked system for obtaining information for a heating, ventilating, and air conditioning (HVAC) system in accordance with an embodiment of the invention.

FIG. 1 shows networked system 100 for obtaining information for heating, ventilating, and air conditioning (HVAC) system 103 in accordance with an embodiment of the invention. HVAC system 103 typically includes different components such as heating unit (furnace) 109 with relay 113 that activates heating unit 109 and cooling unit (air conditioner) 111 with relay 115 that activates cooling unit 111. Information of each component in HVAC system 103 may be important in managing and maintaining networked system 100. For example, system operation of energy management control system 100 may utilize the type of HVAC system 103 and relay information in order to preserve relay life and to control the number of cycles for activating heating unit 109 and cooling unit 111. System 100 provides HVAC information to an end user through monitoring device 105 and network 107 from thermostat 101. Thermostat 101 may collect information from HVAC system 103 and provide the information to monitoring device 105.

With some embodiments, network 107 supports a wireless protocol, including ZigBee™ or other IEEE 802.15.4 based protocols. Additional embodiments include supporting network protocols using a Wi-Fi® protocol, a Bluetooth® protocol, or using wired connections, such as 10 BASE-T or 100 BASE-T Ethernet.

HVAC information may be provided from thermostat 101 to monitoring device 105 in accordance with a ZigBee smart energy specification, e.g., Smart Energy Profile Specification, ZigBee Standards Organization, May 2008 and ZigBee Cluster Library Specification, ZigBee Standards Organization, May 2008, which are incorporated by reference. However, sending HVAC information from thermostat 101 to monitoring device 101 as manufacturing specific information (customer-defined cluster) in a data container (cluster), which may be conveyed by the payload of a ZigBee Cluster Library (ZCL) frame format, may be difficult to an end user because the specific data format is typically not published and thus not easily available to the end user. As will be discussed, HVAC information may be facilitated by including HVAC information in a standard available cluster (publicly accessible cluster).

Figure 2:
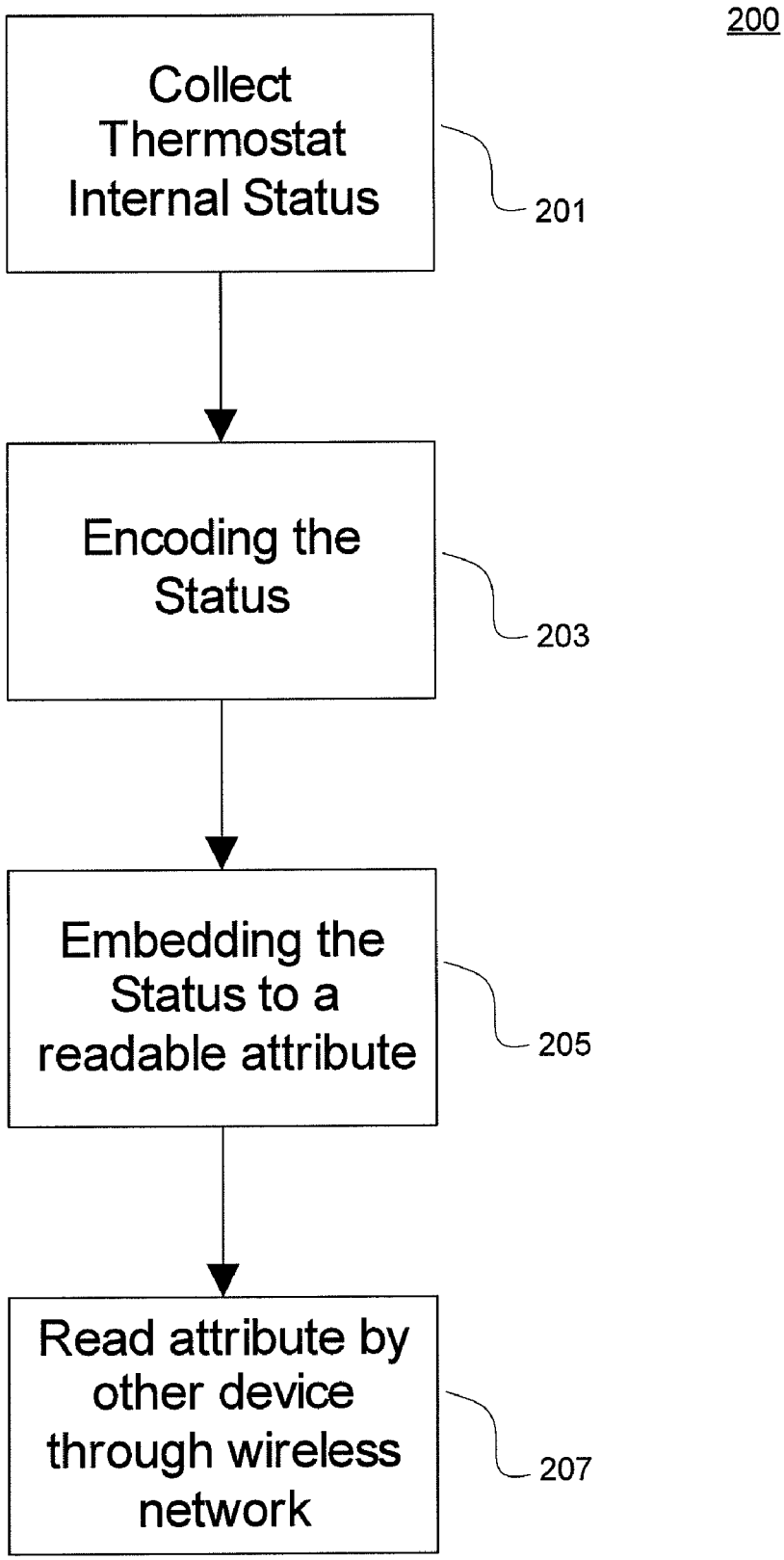
FIG. 2 shows a flow diagram for sending thermostat information in a publicly accessible cluster in accordance with an embodiment of the invention.

FIG. 2 shows flow diagram 200 for sending thermostat information in a publicly accessible cluster in accordance with an embodiment of the invention. In step 201, thermostat 201 receives HVAC information from HVAC system and collects the information as part of the thermostat internal status. As will be discussed in more detail, the internal information may be encoded in step 203 so that the internal information can be embedded readable attribute in a standard available cluster in step 205. Networked device 105 can subsequently read the attribute in a cluster (data container) received through network 107. The networked device sends a request message for each attribute, although with other embodiments, a request message may be sent only once to obtain all of the attributes from thermostat 201.

Thermostat 101 may include different HVAC information in a standard available cluster. For example, thermostat 101 may collect HVAC information, including control relay life, control relay number of cycles, end controlling device type, and the like. The HVAC information may be sent to a server, gateway, or other networked devices through manufacturing specific clusters. In addition, thermostat 101 may encode the HVAC information (e.g., as exemplified in FIG. 5) as sent through a publicly accessible cluster (e.g., ManufacturerName attribute that may be included in the Basic cluster) to an end user through monitoring device 105. The Basic cluster has a cluster ID equal to 0x0000 as specified in ZigBee Cluster Library Specification, ZigBee Standards Organization, May 2008. An end user or value added developer can acquire such information and decode it with a decoding algorithm supported by embodiments of the invention.

Figure 3:
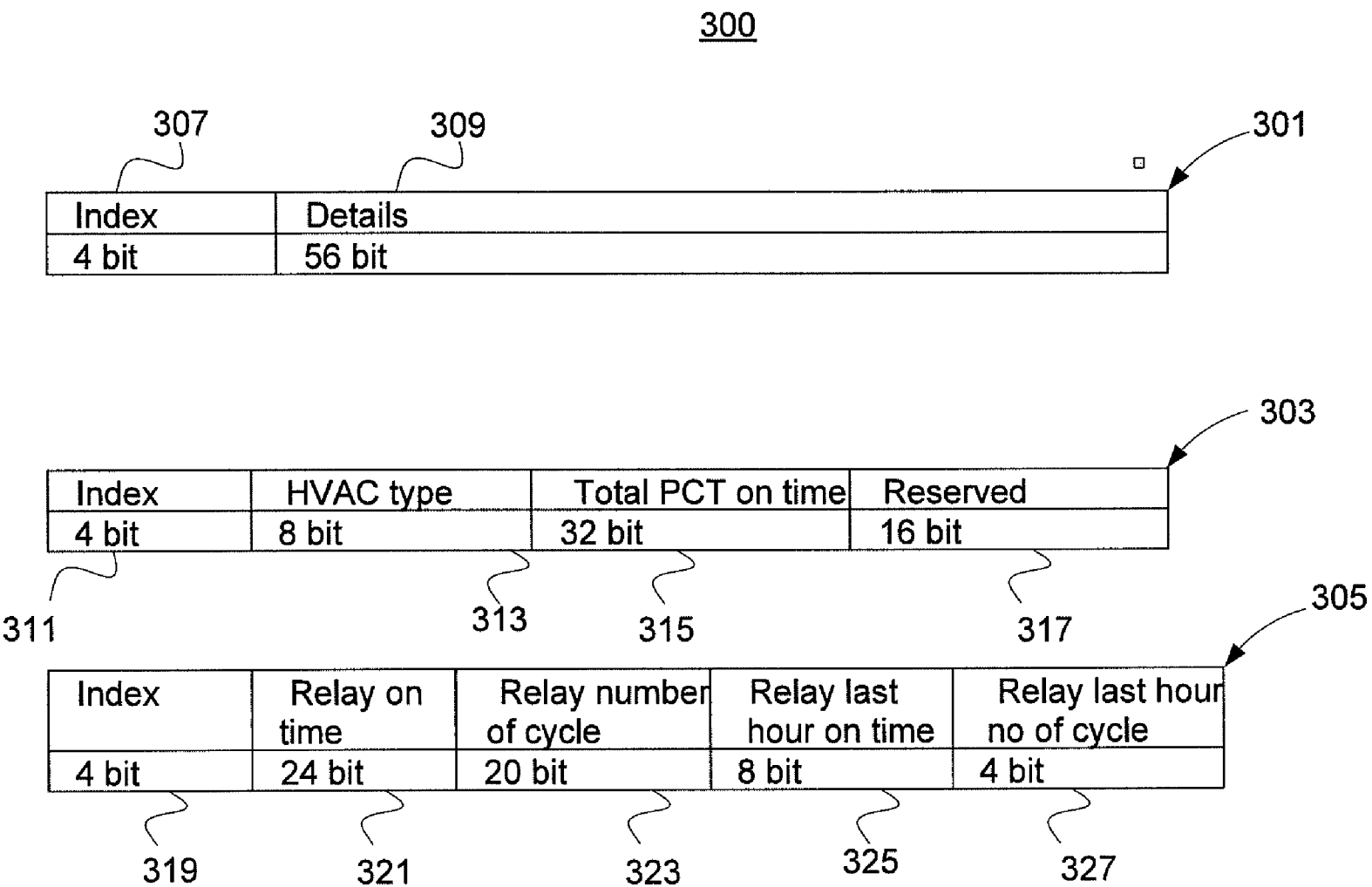
FIG. 3 shows an example of a data structure for embedded thermostat internal information in accordance with an embodiment of the invention.
Figure 5:
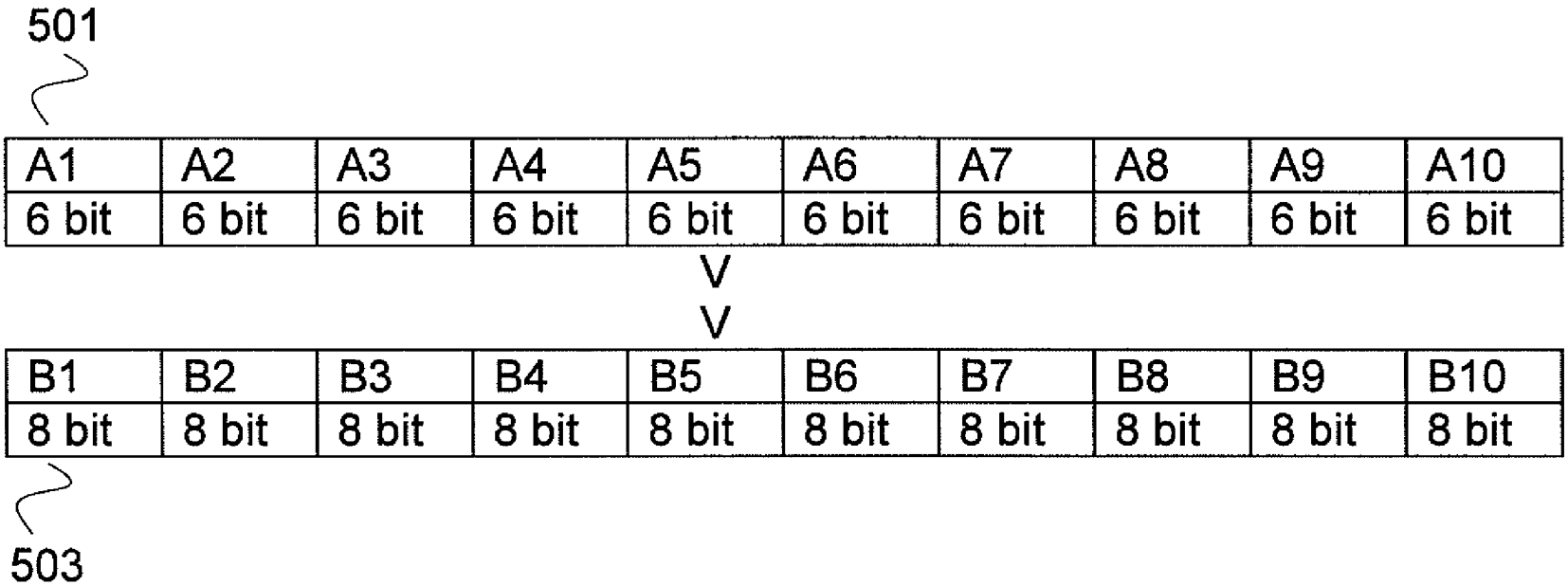
FIG. 5 shows encoded thermostat internal information in accordance with an embodiment of the invention.

FIG. 3 shows exemplary embodiment 300 of a data structure for embedded thermostat internal information in accordance with an embodiment of the invention. The ManufacturerName attribute, as specified in Smart Energy Profile Specification, ZigBee Standards Organization, May 2008, accommodates a maximum 32 bytes. Exemplary embodiment 300 uses 10 bytes for thermostat internal information (TII). Attribute 301, 303, and 305 has an actual data structure if only 60 bits as shown in FIG. 5. However, each 6 bits can only be embedded to 8 bits of data because the ManufacturerName attribute can only allow ASCII codes.

Attribute 301 shows the general data structure that can support attributes 303 and 305. Attributes 303 and 305 contain different HVAC information, which is associated with different index numbers. Attribute 303 includes an index number of '0' to indicate that it contains HVAC type 313, total percentage on time (for HVAC system) 315, and reserved field 317 (which may be used for other HVAC status information). Attribute 305 contains relay information for a specific relay (e.g., relay 113 or relay 115) as identified by the index number 319. With a four-bit index field, exemplary data structure 300 may accommodate a maximum of 15 relays in HVAC system 103. Each attribute 311 contains relay on time 321, relay number of cycles 323, relay last hour on time 325, and relay last number of cycles 327 for the corresponding relay as identified by the index number. For example, when the index number equals '1', the relay information corresponds to heating relay113 and when the index number equals '2', the relay information corresponds to cooling relay 115.

FIG. 4 shows exemplary thermostat internal information 400 in accordance with an embodiment of the invention. Exemplary information includes basic HVAC information 401 and relay information 402-408.

FIG. 5 shows encoded thermostat internal information 503 in accordance with an embodiment of the invention. Thermostat 101 obtains sixty bits of HVAC information 501 from HVAC system 103. Thermostat 101 encodes HVAC information 501 into encoded HVAC information 503 (ten byte ASCII code). For each six bits of the 60 bit data, thermostat 101 transforms (encodes) each six bits of HVAC 501 to eight bits of encoded HVAC information 503. In order to obtain a valid displayable ASCII code for each field of encoded HVAC information 503, thermostat 101 adds '32' to each field of HVAC information 501 (i.e., B1=A1+32).

By applying the reverse conversion process, a receiving device (e.g., monitoring device 105) can decode encoded HVAC information 503 to HVAC information 501. With the first read attribute, the receiving device receives a ManufacturerName attribute with an index number equal to '0', thus indicating the HVAC system type and overall PCT information. Each subsequent read (having an index number greater than '0') contains relay information for the corresponding HVAC relay.

Figure 6:
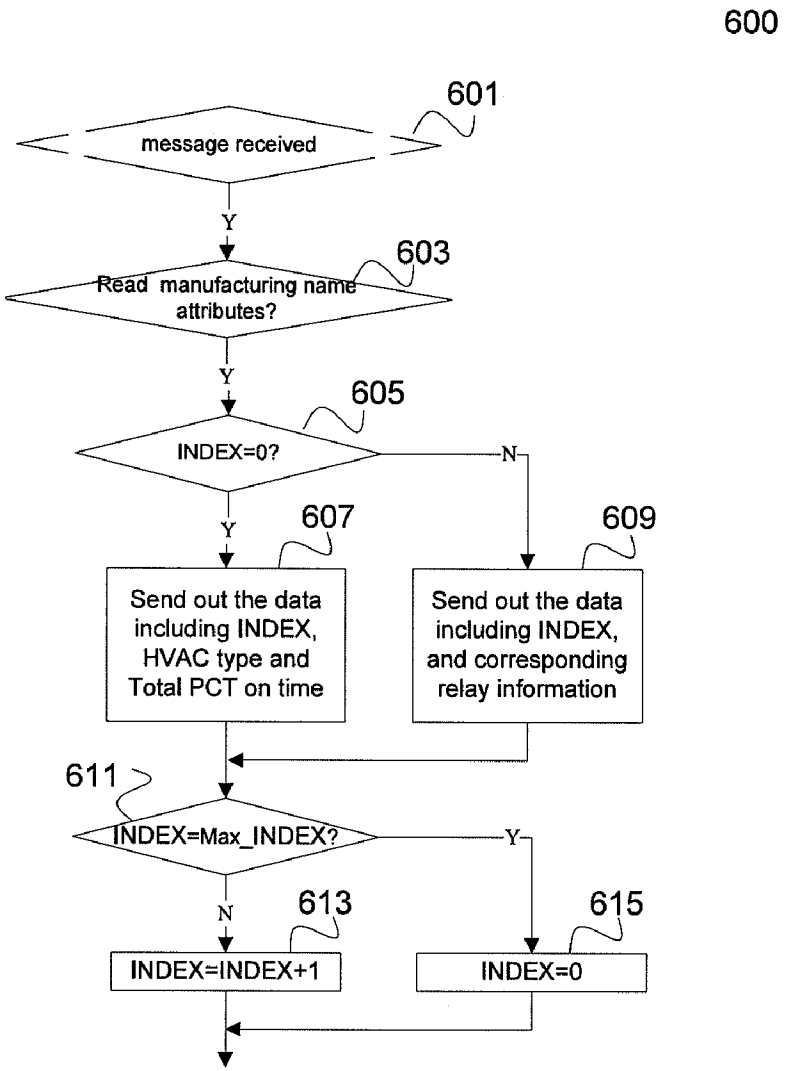
FIG. 6 shows a flow diagram for sending thermostat internal information to another networked device in accordance with an embodiment of the invention.

FIG. 6 shows flow diagram 600 for sending thermostat internal information to a networked device (e.g., device 105) in accordance with an embodiment of the invention. HVAC information is sent to a networked device through network 107 by embedding the information into a commonly available readable attribute (e.g., ManufacturerName attribute). In step 601, networked device 105 sends a request to read ManufacturerName attribute with HVAC information by thermostat 101 through network 107. Step 603 determines whether the request message is to read ManufacturerName attribute. In steps 605-615, the index number (INDEX) is controlled by thermostat 101, where the value of INDEX is increased by one after each read attribute. Steps 607 and 609 send different HVAC information in a data container (cluster), in which the HVAC information is associated with an index number. When the index number equals '0', thermostat 101 sends the HVAC type (corresponding to attribute 303 as shown in FIG. 3). When the index number is not equal to '0', thermostat 101 sends relay status information (corresponding to attribute 305). Thermostat 101 increments the index number in step 613 if the index number is not equal to the maximum index number (e.g., 7 for the example shown in FIG. 4) as determined by step 611. When the index number equals the maximum index number (the number of monitored relays in the HVAC system), the index number is reset to '0' in step 615.

Figure 7:
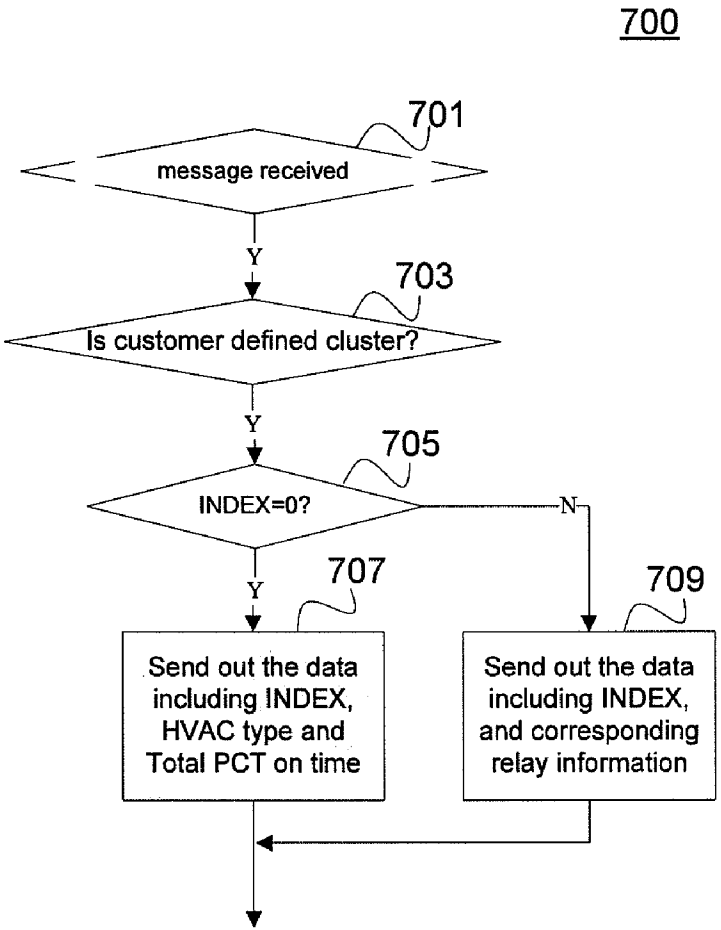
FIG. 7 shows a flow diagram for sending thermostat internal information to another networked device in accordance with an embodiment of the invention.

FIG. 7 shows flow diagram 700 for sending thermostat internal information to another networked device in accordance with an embodiment of the invention. HVAC information is sent to a networked device through network 107 by creating a customer-defined cluster. The index number (INDEX) is controlled by the requesting device (e.g., device 105), where the index is included in a customer-defined cluster. The customer-defined cluster is typically proprietary and is not published. In step 701, networked device 105 sends a request for HVAC information with an index number to thermostat 101 through network 107. Step 703 determines whether the request message indicates that the HVAC information is to be embedded into a customer-defined cluster. In step 705, if the index number is equal to '0', thermostat 101 sends the HVAC type to the networked device in step 707. If the index number is not equal to '0', thermostat 101 sends the relay information corresponding to the index number in step 709.

Figure 8:
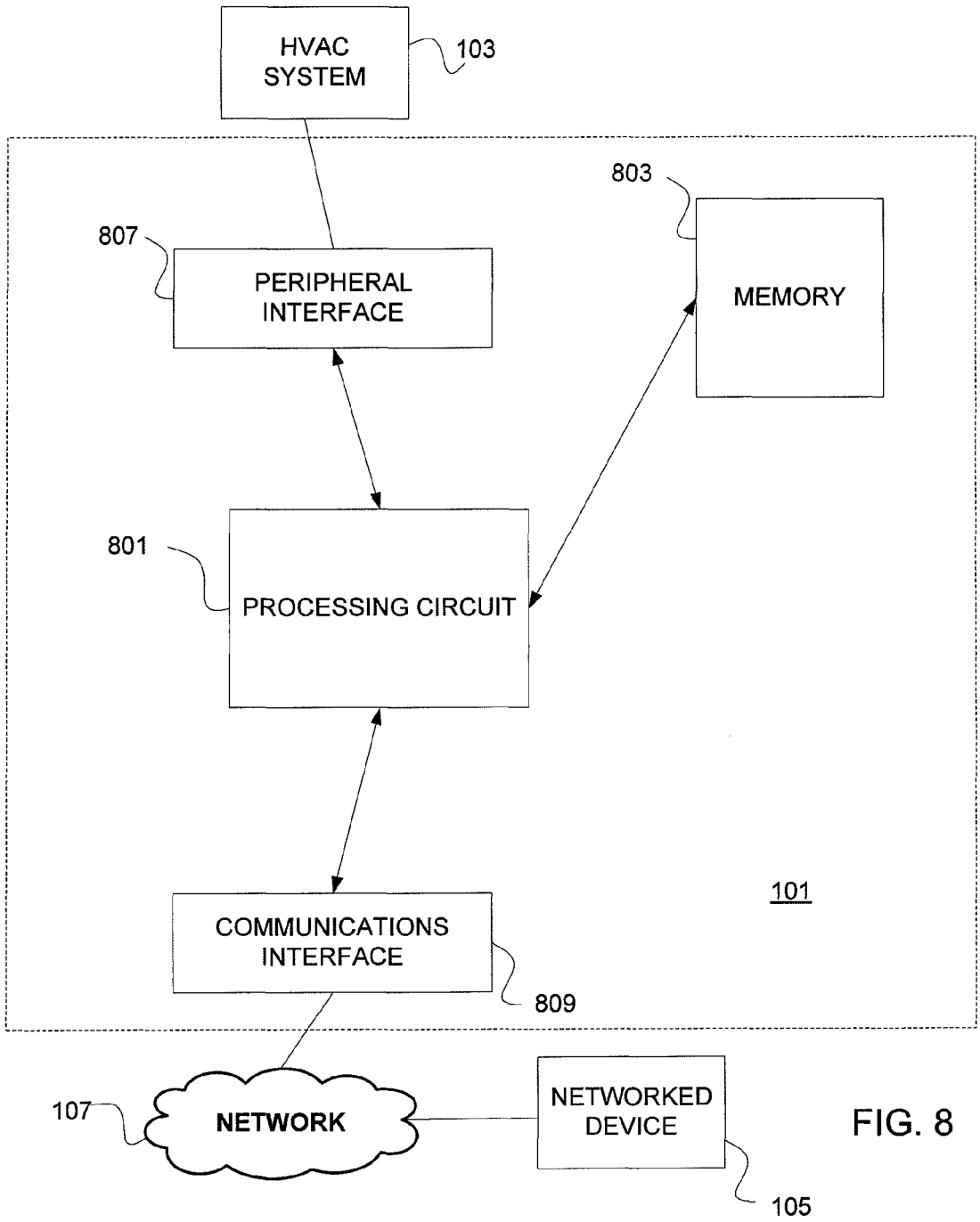
FIG. 8 shows an apparatus for obtaining and encoding thermostat internal information in accordance with an embodiment of the invention.

FIG. 8 shows apparatus 101 (e.g. a thermostat) for obtaining and encoding thermostat internal information in accordance with an embodiment of the invention. Apparatus 101 interfaces with HVAC system 103 through peripheral interface 807 in order to obtain HVAC information. Processor 801 processes the HVAC information and formats the HVAC information into an appropriate data container (e.g., cluster) and sends the data container to networked device 105 through communications device 809 and network 107 by executing a process (e.g., process 600 or 700).

Embodiments of the invention may include forms of computer-readable media as supported by memory 803. Computer-readable media include any available media that can be accessed by processing circuit 801. Computer-readable media may comprise storage media and communication media. Storage media include volatile and nonvolatile, removable and non-removable media implemented in any method or technology for storage of information such as computer-readable instructions, object code, data structures, program modules, or other data. Communication media include any information delivery media and typically embody data in a modulated data signal such as a carrier wave or other transport mechanism.

Figure 9:
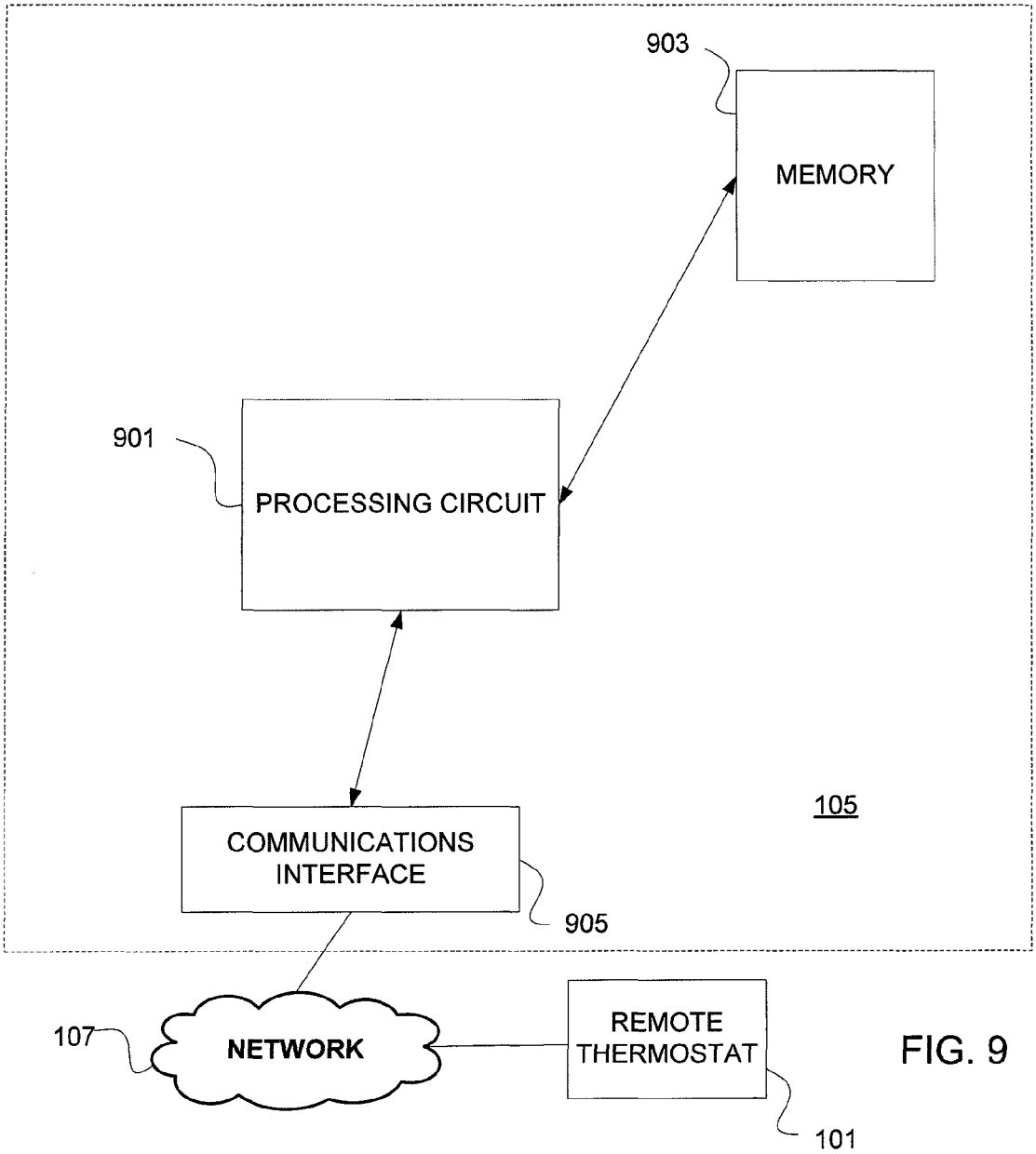
FIG. 9 shows an apparatus for receiving thermostat internal information in accordance with an embodiment of the invention.

FIG. 9 shows apparatus 105 (e.g., a networked monitoring device) for receiving thermostat internal information in accordance with an embodiment of the invention. Processing circuit 901 requests and obtains HVAC information from thermostat 101 through network 107 and communications interface 905. Processing circuit 901 may store the HVAC information into memory 903 for subsequent access or may further process the HVAC information to manage HVAC system 103.

Memory 903 supports computer-readable media that can be accessed by a computing device 901 in accordance with the previous discussion.

As can be appreciated by one skilled in the art, a computer system with an associated computer-readable medium containing instructions for controlling the computer system can be utilized to implement the exemplary embodiments that are disclosed herein. The computer system may include at least one computer such as a microprocessor, digital signal processor, and associated peripheral electronic circuitry.

Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims.

What is claimed is:

1. An apparatus comprising:

a memory; and a processor configured to retrieve computer-executable instructions from the memory and to perform:

obtaining a first status information from a heating, ventilating, and air conditioning (HVAC) system, wherein the first status information comprises a relay status of a relay in the HVAC system and wherein the relay status comprises relay on time information and relay number of cycles information;

unconditionally associating a first index number with the first status information, wherein the first status information includes a current value of a characteristic in the HVAC system;

including the first index number in an attribute of a data container; and sending the data container to a networked device.

2. The apparatus of claim 1, wherein the processor is further configured to:

receive a second status information from a HVAC system;

associate a second index number with the second status information and include the second index number with the second status information in the attribute.

3. The apparatus of claim 1, wherein the data container comprises a publicly accessible cluster.

4. The apparatus of clam 3, wherein the processor is further configured to:

encode the first status information that is embedded in a readable attribute of the publicly accessible cluster.

5. The apparatus of claim 1, wherein the data cluster comprises a customer-defined cluster.

6. The apparatus of claim 1, further comprising:

a communications interface configured to communicate with the networked device through a wireless network.

7. A non-transitory computer-readable medium having computer-executable instructions that when executed perform:

obtaining a first status information from a heating, ventilating, and air conditioning (HVAC) system, wherein the first status information comprises a relay status of a relay in the HVAC system and wherein the relay status comprises relay on time information and relay number of cycles information;

unconditionally associating a first index number with the first status information, wherein the first status information includes a current value of a characteristic in the HVAC system;

including the first index number in an attribute of a data container and sending the data container to a networked device.

8. The non-transitory computer-readable medium of claim 7, further including computer-executable instructions that when executed perform:

receiving a second status information from a HVAC system;

associating a second index number with the second status information; and including the second index number with the second status information in the attribute.

9. The non-transitory computer-readable medium of claim 7, further including computer-executable instructions that when executed perform:

encoding the first status information that is embedded in a readable attribute of a publicly accessible cluster.

10. An apparatus comprising:

a memory; and a processor configured to retrieve computer-executable instructions from the memory and to perform:

receiving a data container having a plurality of status information from a heating, ventilating, and air conditioning (HVAC) system in at least one data container, wherein each status information is unconditionally associated with a different index number and includes a current value of a characteristic in the HVAC system; and reading a selected status information using a selected index number, wherein the selected status information comprises a relay status of a relay in the HVAC system and wherein the relay status comprises relay on time information and relay number of cycles information.

11. The apparatus of claim 10, wherein the data container comprises a publicly accessible cluster.

12. The apparatus of claim 11, wherein the processor is further configured to:

decode the selected status information that is embedded as a readable attribute of the publicly accessible cluster.

13. The apparatus of claim 10, wherein the data container comprises a customer-defined cluster.

14. An apparatus comprising:

a memory; and a processor configured to retrieve computer-executable instructions from the memory and to perform:

obtaining first relay information of a first relay in a heating, ventilating, and air conditioning (HVAC) system, wherein the first relay information comprises relay on time information and relay number of cycles information;

unconditionally associating a first index number with the first relay information, wherein the first relay information includes a current state of the first relay;

including the first index number in an attribute of a publicly accessible cluster;

encoding the first relay information to be embedded in the attribute of the publicly accessible cluster;

obtaining a second relay information of a second relay in the HVAC system;

associating a second index number with the second relay information, wherein the first index number is different from the second index number;

including a second index number in the attribute of the publicly accessible cluster;

encoding the second relay information to be embedded in the attribute of the publicly accessible cluster; and sending the publicly accessible cluster to a networked device.

* * * * *